US011761723B2

(12) United States Patent
Pavel

(10) Patent No.: US 11,761,723 B2
(45) Date of Patent: Sep. 19, 2023

(54) PORTABLE FIREARM

(71) Applicant: Sorin Pavel, Hannover (DE)

(72) Inventor: Sorin Pavel, Hannover (DE)

( * ) Notice: Subject to any disclaimer, the term of this patent is extended or adjusted under 35 U.S.C. 154(b) by 0 days.

(21) Appl. No.: 17/532,365

(22) Filed: Nov. 22, 2021

(65) Prior Publication Data

US 2022/0178636 A1 Jun. 9, 2022

(30) Foreign Application Priority Data

Dec. 8, 2020 (DE) ..... 10 2020 132 603.3

(51) Int. Cl.
*F41A 11/04* (2006.01)
*F41C 23/16* (2006.01)

(52) U.S. Cl.
CPC ..... *F41A 11/04* (2013.01); *F41C 23/16* (2013.01)

(58) Field of Classification Search
CPC ..... F41A 11/04; F41C 23/16
See application file for complete search history.

(56) References Cited

U.S. PATENT DOCUMENTS 1,563,438 A * 12/1925 Russell ..... F41A 19/09 89/127
2,136,512 A * 11/1938 Laloux ..... F41A 11/04 89/33.2
2,230,328 A * 2/1941 Krum ..... F41A 21/484 89/44.01
2,457,824 A * 1/1949 Kochevar ..... F41A 23/02 89/37.02
3,091,878 A * 6/1963 Savioli ..... F41A 19/09 42/69.01
4,803,910 A * 2/1989 Troncoso ..... F41A 19/09 89/129.02
5,949,015 A * 9/1999 Smith ..... F41G 3/22 89/41.09
6,237,462 B1 * 5/2001 Hawkes ..... F41A 23/12 89/41.17
6,286,411 B1 * 9/2001 Sanderson ..... B64D 7/02 89/37.14
6,526,683 B1 * 3/2003 Crandall ..... F41A 19/09 42/75.01
6,543,173 B1 * 4/2003 Golan ..... F41C 9/00 89/14.05
7,200,966 B2 * 4/2007 Gooder ..... F41C 23/14 42/71.01
7,437,847 B1 * 10/2008 Mabry ..... F41C 23/12 42/73
7,520,206 B2 * 4/2009 Baker ..... F41H 5/08 89/36.06

(Continued)

FOREIGN PATENT DOCUMENTS

WO 2017/157988 A1 9/2017
WO 2019/200150 A1 10/2019

*Primary Examiner* — Michelle Clement
(74) *Attorney, Agent, or Firm* — Collard & Roe, P.C.

(57) ABSTRACT

A portable firearm includes component parts such as a barrel, a locking mechanism, a grip, a stock and a magazine. The grip has a left and a right grip element, wherein the user of the firearm grasps the left grip element with the left hand and the right grip element with the right hand, in order to bring the firearm into a shooting position, preferably centrally in front of his body, in which the open end of the barrel of the firearm points away from the body of the user.

18 Claims, 6 Drawing Sheets

(56) References Cited

U.S. PATENT DOCUMENTS 7,552,557 B1 * 6/2009 Mabry ..... F41A 11/04 42/71.01
7,698,848 B1 * 4/2010 Bentley ..... F41C 23/04 42/73
8,069,767 B2 * 12/2011 Deckard ..... F41A 9/62 42/98
8,109,026 B1 * 2/2012 Bentley ..... F41C 23/04 42/73
8,151,507 B2 * 4/2012 Johnson ..... F41A 23/16 248/166
8,205,374 B2 * 6/2012 Lamm ..... F41C 23/12 42/72
8,245,432 B2 * 8/2012 Letson ..... F41A 23/16 89/37.04
8,479,432 B2 * 7/2013 Braun ..... F41H 13/0018 42/106
8,544,202 B2 * 10/2013 Bastian, Jr. ..... F41A 23/02 89/37.03
8,584,393 B2 * 11/2013 McCrimmon, Jr. .... F41C 27/00 89/37.03
8,584,573 B2 * 11/2013 Prado ..... F41A 27/16 89/37.03
8,590,440 B2 * 11/2013 Gallo ..... F41A 23/16 89/37.04
8,640,597 B2 * 2/2014 Hayden ..... F41G 5/24 89/37.03
8,707,604 B2 * 4/2014 Troy ..... F41A 23/10 42/72
9,027,273 B1 * 5/2015 Clinkenbeard ..... F41C 33/08 42/72
9,146,075 B2 * 9/2015 Malik ..... F41C 23/14
9,175,804 B1 * 11/2015 Knight, Sr. ..... F16M 13/04
9,194,649 B2 * 11/2015 Nierenberg ..... F41C 23/08
9,239,211 B2 * 1/2016 Percival ..... F41C 33/001
9,335,112 B1 * 5/2016 Sholley ..... F41C 33/001
9,341,439 B2 * 5/2016 Michal ..... F41C 23/16
9,345,240 B1 * 5/2016 Cain, Jr. ..... F41C 27/00
9,423,207 B2 * 8/2016 Hunkley ..... F41C 23/12
9,441,909 B2 * 9/2016 Malik ..... F41C 23/04
9,500,316 B2 * 11/2016 Terpening ..... A45F 5/00
9,587,908 B2 * 3/2017 Bjelde ..... F41C 33/007
9,677,846 B1 * 6/2017 Vankeuren, III ..... F41A 17/46
9,829,265 B2 * 11/2017 Reed ..... F41A 23/16
9,909,830 B1 * 3/2018 Toole ..... F41G 1/35
9,927,207 B1 * 3/2018 Haugland ..... F41C 27/00
9,945,629 B2 * 4/2018 Osborne ..... F41A 9/17
10,077,869 B2 * 9/2018 Semple ..... F16M 13/04
10,088,272 B2 * 10/2018 Echevarria ..... F41C 33/002
10,101,110 B2 * 10/2018 Faifer ..... F41A 23/10
10,126,079 B2 * 11/2018 Voigt ..... F41A 3/06
10,151,556 B2 * 12/2018 Kjellberg ..... F41C 9/02
10,371,486 B2 * 8/2019 Geissele ..... F41A 3/66
10,393,476 B2 * 8/2019 Green ..... F16M 11/10
10,443,971 B2 * 10/2019 Kielsmeier ..... F41A 3/66
10,627,189 B2 * 4/2020 Faifer ..... F41C 27/22
10,641,567 B2 5/2020 Weilharter
10,731,937 B2 * 8/2020 Schacht ..... F41A 19/15
10,760,874 B2 * 9/2020 Kjellberg ..... F41C 9/02
10,794,658 B2 * 10/2020 Walthert ..... F41B 5/12
10,801,800 B1 * 10/2020 Chia ..... F41C 23/16
10,845,156 B1 * 11/2020 Fortin ..... F41A 3/66
10,871,345 B2 * 12/2020 Faifer ..... F41C 23/12
10,976,132 B2 * 4/2021 Pilkama ..... F41C 33/002
11,029,109 B2 * 6/2021 Golan ..... F41C 23/04
11,118,861 B2 * 9/2021 Holmes ..... F41C 23/14
11,156,426 B2 * 10/2021 Chia ..... F41C 23/16
11,156,433 B2 * 10/2021 Griffith ..... F24F 11/72
11,262,159 B2 * 3/2022 Kielsmeier ..... F41A 35/06
11,320,226 B2 * 5/2022 Roberts ..... F41A 23/10
11,353,283 B2 * 6/2022 Cuenca ..... F41C 23/16
11,353,284 B2 * 6/2022 Hall ..... F41A 3/66
11,371,801 B2 * 6/2022 Shinkle ..... F41C 23/14
11,378,354 B1 * 7/2022 Porat ..... F41C 23/16
11,385,020 B2 * 7/2022 Grenier ..... F41C 23/14
11,391,538 B2 * 7/2022 Cabahug ..... F41C 23/16
2006/0010746 A1 * 1/2006 Little ..... F41C 23/04 42/69.01
2007/0023467 A1 * 2/2007 Spreer ..... F41C 33/005 224/913
2007/0051235 A1 * 3/2007 Hawkes ..... F41A 27/26 89/37.03
2007/0261287 A1 * 11/2007 Hunt ..... F41C 33/002 42/94
2008/0217371 A1 * 9/2008 Wemmer ..... F41C 23/02 224/579
2009/0211140 A1 * 8/2009 Rolfe ..... F41C 23/04 42/71.01
2009/0229160 A1 * 9/2009 Elliott ..... F41A 23/04 42/71.01
2010/0242335 A1 * 9/2010 Duval ..... F41C 27/22 224/258
2011/0042427 A1 * 2/2011 Goransson-Sonnefelt ..... F41C 33/005 224/682
2011/0113670 A1 * 5/2011 Stafford ..... F41A 23/08 42/94
2011/0261204 A1 * 10/2011 Smith ..... F41G 3/165 348/E7.091
2013/0074685 A1 * 3/2013 Cottle ..... F41A 19/06 89/27.11
2013/0232844 A1 * 9/2013 Gallo ..... F41A 23/16 42/94
2015/0253105 A1 * 9/2015 Brubaker ..... F41A 3/72 42/90
2015/0369560 A1 * 12/2015 Chiang ..... F41C 33/002 224/150
2016/0153743 A1 * 6/2016 Hawkins ..... F41A 23/10 42/71.01
2016/0305740 A1 * 10/2016 O'Donnell ..... F41F 1/10
2017/0153084 A1 * 6/2017 Tarazi ..... F41A 9/65
2017/0307327 A1 * 10/2017 Cross ..... F41C 23/06
2018/0031350 A1 * 2/2018 Rohel ..... F41C 33/002
2018/0051952 A1 2/2018 Rowe et al.
2019/0093976 A1 * 3/2019 Power ..... F16F 9/0218
2019/0226797 A1 * 7/2019 Faifer ..... F41A 3/72
2019/0249969 A1 * 8/2019 Griffith ..... F41A 17/38
2020/0340772 A1 * 10/2020 Bowman ..... F41A 23/10
2021/0116209 A1 * 4/2021 Faifer ..... F41C 23/12
2021/0156642 A1 * 5/2021 Kjellberg ..... F41C 9/02
2021/0180912 A1 * 6/2021 Brauer ..... F41C 23/16
2021/0278168 A1 * 9/2021 Mantas ..... F41C 23/16
2021/0310765 A1 * 10/2021 Ding ..... F41C 23/14
2022/0214129 A1 * 7/2022 Puha ..... F41A 21/325
2022/0282950 A1 * 9/2022 Aldstadt ..... F41C 23/16

* cited by examiner

PORTABLE FIREARM

CROSS REFERENCE TO RELATED APPLICATIONS

Applicant claims priority under 35 U.S.C. § 119 of German Application No. 10 2020 132 603.3 filed Dec. 8, 2020, the disclosure of which is incorporated by reference.

BACKGROUND OF THE INVENTION

1. Field of the Invention

The invention relates to a portable firearm having as component parts a barrel, a locking mechanism, a grip, a stock, and a magazine.

2. Description of the Related Art

As described in the introduction of WO 2017/157988 A1, the threat scenario of the cold war, which extended into the late 80s and early 90s, and in which the armies confronted one another and had to operate in troop maneuvers and positional warfare, is fading more and more into the background in such a form. Modern conflicts are dominated by scenarios resembling civil war and by local terrorist actions in the urban environment. Thus house-to-house fighting can be increasingly assumed to be the arena.

In this urban and constricted combat zone, the assault weapons of the soldiers, some designed in the 70s, are obviously too long, too clumsy and obsolete. The cartridges they fire are too powerful. Bursts of fire are limited to 20 cartridges. The frequent changing of magazines limits the efficiency of target engagement and increases the risk for the shooter, because he or she cannot fire while changing the magazine but is still exposed to return fire. In addition, the switch from carrying position to shooting position takes disadvantageously too long, especially when the assault weapon is carried upon the back. This process requires several hand movements, which also include a manipulation of the carrying system, especially the weapon strap. A soldier who has to fight in close combat or in urban terrain with targets at short range, for example in a staircase in a row of houses, should have a firearm that permits an agile and mobile operation in tight spaces.

SUMMARY OF THE INVENTION

The object of the present invention is therefore to provide an improved portable firearm for fighting in urban terrain.

These and other objects are accomplished for a portable firearm by the characterizing features according to the invention. Further developments and advantageous configurations of the invention are discussed below.

The portable firearm according to the invention comprises as component parts in particular a barrel, a locking mechanism, a grip, a stock and a magazine, and is characterized in that the grip has a left and a right grip element, wherein the shooter or user of the firearm grasps the left grip element with the left hand and the right grip element with the right hand, in order to bring and hold the firearm in a shooting position, preferably centrally in front of his or her body, in which the open end of the barrel of the firearm points away from the body of the user of the firearm.

Because the firearm is held in shooting positions upon a left and a right grip element in front of the upper body of the user, the firearm can be constructed such that it is compact and short and can be rapidly swiveled. The firearm according to the invention permits a rapid reaction time of the user or shooter. The ability to track fast-moving targets at short distance is improved by the easy swiveling ability of the firearm. In particular, the firearm need be designed for only short to medium range. Targets with rapidly changing angle can be hit.

Because a left and a right grip element are provided, they may also be referred to as a double front grip. Preferably the grip elements are constructed to be symmetrical to one another. In this respect they may also be referred to as a symmetric double front grip.

The term "grip" is therefore to be broadly interpreted within the meaning of the invention. It may be constructed in one piece or in multiple pieces. What is important is that it has a left and a right grip element, wherein the grip elements are preferably disposed at the same height. In this respect, the possibility also exists that the grip consists of two parts spaced apart from one another, wherein the one part forms the left grip element and the other part the right grip element.

It may be of advantage when the grip elements are disposed upon, preferably on, a preferably plate-shaped support structure, wherein at least some component parts of the firearm can be and/or are disposed upon, preferably on and/or below the support structure.

It may be of advantage when the grip is disposed in front of the center of gravity of the firearm relative to the shooting direction of the firearm. This arrangement advantageously permits the swiveling of the weapon in the same direction in which the target is moving, which corresponds to the natural, instinctive behavior, and it makes the tracking of the target a rapid and reliable action. This procedure differs from the procedure with pivot-mounted weapons, the grips of which must be swiveled in the inverse direction relative to the direction of movement of the target.

It may be of advantage when the grip is disposed at least predominantly, preferably completely above the barrel.

It may be of advantage when the grip is constructed to be U-shaped, wherein the left grip element is formed by the one leg of the U and the right grip element by the other leg of the U.

It may be of advantage when the legs forming the free ends of the grip elements are joined to the support structure and when the part of the U-shaped grip joining the two legs is disposed spaced apart from the support structure and is transverse relative to the barrel.

It may be of advantage when at least one trigger is provided, which is disposed in such a way that it can be actuated by at least one finger, preferably a thumb, of one hand of the user, when the firearm is in the shooting position.

It may be of advantage when two triggers are provided, which are disposed so that one trigger can be actuated by at least one finger, preferably by the thumb, of the left hand of the user and the other trigger can be actuated by at least one finger, preferably by the thumb, of the right hand of the user when the firearm is in the shooting position.

It may be of advantage when the firearm is constructed in such a way that one or more than one shot can be fired only when both triggers are actuated simultaneously. Thereby the danger of hand injuries at the muzzle of the firearm are reduced and thus the safety is increased.

It may be of advantage when the firearm has a carrying system, via which the firearm is in each case held in front of the body of the user both in a shooting position, in which the open end of the barrel of the firearm points forward and in a transport position, in which the open end of the barrel of the firearm points downward.

It may be of advantage when the firearm, by means of a carrying system, is suspended with swiveling capability upon the user in front of the body of the user, wherein the center of gravity of the suspended firearm is preferably chosen such that a smooth swiveling of the firearm by 90 degrees from a transport position into a shooting position is possible.

It may be of advantage when the carrying system has at least one belt, which preferably is joined to the support structure, in order to fasten the firearm upon the user, especially upon backpack straps, if the user is carrying a backpack, or upon a protective vest, if the user is wearing one such.

It may be of advantage when the carrying system has at least one figure eight belt, in order to fasten the firearm upon the user, especially if the user is neither carrying a backpack nor wearing a protective vest.

It may be of advantage when at least one aiming device, preferably a reflecting sight, a laser targeting device, or the like, is disposed upon the grip, preferably upon the part of the U-shaped grip joining the two legs. Preferably this arrangement is achieved via at least one mounting rails, preferably via several mounting rails, which are joined to the grip.

It may be of advantage when the grip has at least one safety for blocking the trigger.

It may be of advantage when the grip has at least one trigger, preferably in the transition region between one leg and the part of the U-shaped grip joining the two legs.

It may be of advantage when the stock, which preferably is disposed on the side of the support structure pointing toward the body of the user when the firearm is in shooting position, is provided on the side pointing toward the body of the user with a surface, which is in contact with a chest region situated between the shoulders of the user when the firearm is in shooting position.

Thereby precision is substantially increased, because a rotation of the body under the influence of the recoil force is prevented. In addition, the load on the shooter due to the pressure on the body as a result of the recoil force is advantageously reduced, because a larger contact area is available.

It may be of advantage when the firearm has at least one transport grip in addition to the grip designed for holding the firearm in shooting position, wherein the transport grip is disposed preferably in the direction of the barrel, and thus in longitudinal direction of the firearm, preferably on the support structure.

It may be of advantage when at least one, preferably mechanical, aiming device, especially notch and bead, is disposed upon, preferably on, the transport grip.

It may be of advantage when the magazine is a high-capacity magazine, preferably a pan-type magazine, which preferably is disposed below the support structure.

Thereby the efficiency of the firing is increased, because long, uninterrupted bursts of fire are possible. An additional advantage is that no frequent change of magazine is necessary, whereby the safety of the user of the firearm is increased.

The rapidly changing angle of the target requires not only a short and thereby rapidly swivelable weapon, but also a high number of shots. When massed targets are encountered, bursts of fire are additionally necessary. The short to medium engagement range necessitates a low kinetic energy of the projectile. This requirement in turn is achieved with compact cartridges. The light mass of the cartridges permits the inclusion of a large number of cartridges in a high-capacity magazine, preferably pan-type magazine. The high firepower is also useful for defense against surprise attacks, for offensive actions, for rapidly crossing territories that are partly controlled by hostile forces, for holding down hostile forces by barrage fire.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
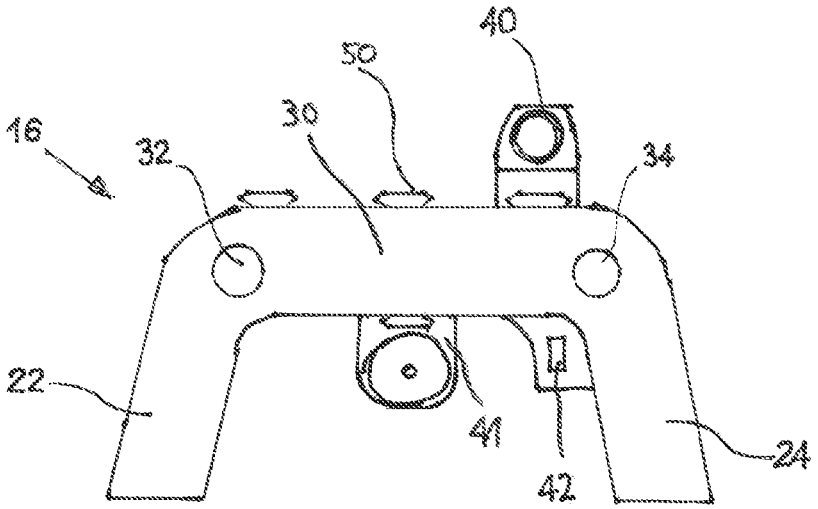
FIG. 1 shows a schematic rear view of the grip of the firearm according to the invention.

Where like reference numerals are used in FIGS. 1 to 12, they refer to like parts or component parts, so that, for the purpose of avoidance of repetitions, already described parts or component parts do not have to be addressed again for every description of the figures.

FIG. 1 shows a schematic rear view of the grip 16 of a firearm 10, not illustrated here, according to the invention.

The grip 16 has a left and a right grip element 22, 24, wherein the user 26 of the firearm 10 grasps the left grip element 22 with the left hand and the right grip element 24 with the right hand, in order to bring the firearm 10 into a shooting position, preferably centrally in front of the body of the user 26, especially in front of the upper body in the chest region. The grip 16 is constructed to be U-shaped, wherein the left grip element 22 is formed by the one leg of the U and the right grip element 24 by the other leg of the U. It could also be said that the grip 16 is constructed in arched form, in the manner of a bridge.

Via mounting or profile rails 50, two aiming devices, especially a reflecting sight 40 and a laser targeting device 41, are disposed upon the part 30 of the U-shaped grip joining the two legs.

In addition, the U-shaped grip 16 has respectively a trigger 32, 34 in the transition region between one leg and the part 30 joining the two legs. In addition, the grip 16 has at least one safety 42 for blocking the trigger 32, 34.

The two triggers 32, 34 are disposed in such a way that the left trigger 32 can be actuated by the thumb of the left hand of the user 26 and the right trigger 34 by the thumb of the right hand of the user 26 when the firearm 10 is in the shooting position.

Preferably the firearm 10 is constructed in such a way that one or more than one shot can be fired only when both triggers 32, 34 are actuated simultaneously.

Figure 2:
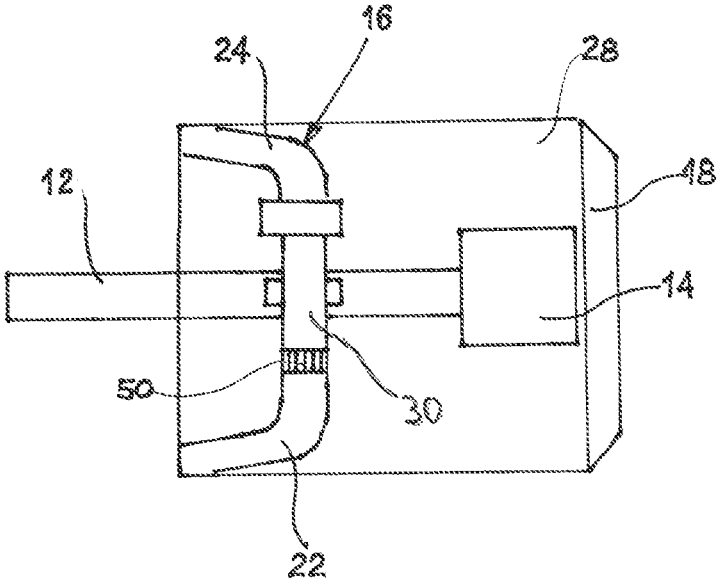
FIG. 2 shows a schematic overhead view of a firearm according to the invention.
Figure 3:
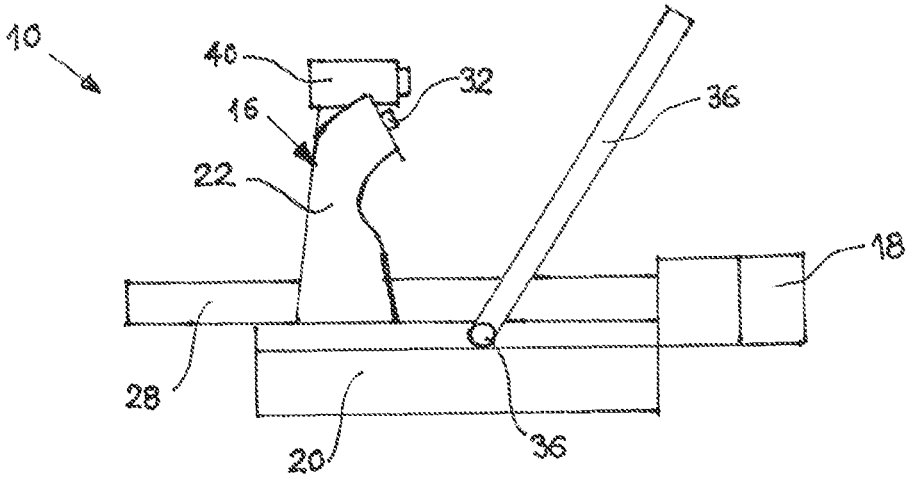
FIG. 3 shows a schematic view from the left side of the firearm according to the invention.

FIG. 2 shows a schematic overhead view of a firearm 10 according to the invention, which as component parts has a barrel 12, a locking mechanism 14, a grip 16, a stock 18 and a magazine 20 (see FIG. 3). Obviously, still further component parts not illustrated here can be and usually are present. The grip 16 has a left and a right grip element 22, 24, wherein the user 26 of the firearm 10 grasps the left grip element 22 with the left hand and the right grip element 24 with the right hand, in order to bring the firearm 10 into a shooting position, preferably centrally in front of the body of the user 26, especially in the chest region of the upper body, in which position the open end of the barrel 12 of the firearm 10 points away from the body of the user 26 in target direction.

The grip 16 is constructed to be U-shaped, wherein the left grip element 22 is formed by the one leg of the U and the right grip element 24 by the other leg of the U. The free ends of the legs forming the grip elements 22, 24 are joined in this case to a plate-like support structure 28, wherein the part 30 of the U-shaped grip 16 joining the two legs is disposed spaced apart from the support structure 28 and is transverse relative to the barrel 12. Further component parts 12, 14, 18 of the firearm 10 are disposed upon the support structure 28.

Figure 9:
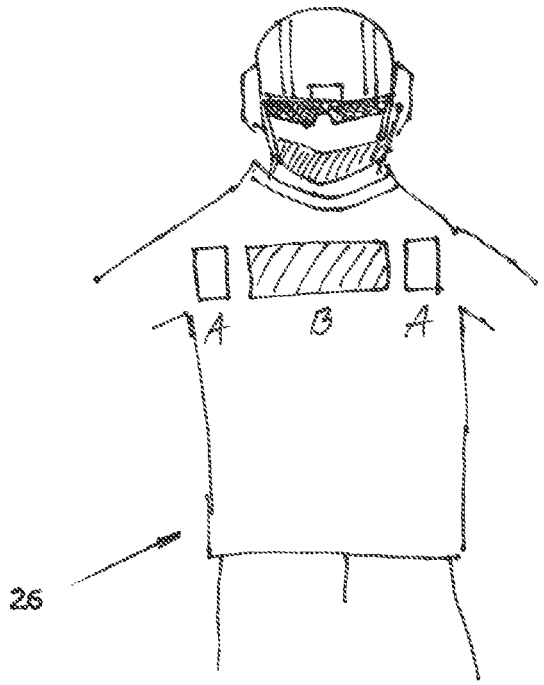
FIG. 9 shows a schematic diagram of the contact surface of a user intended for support for the firearm.
Figure 10:
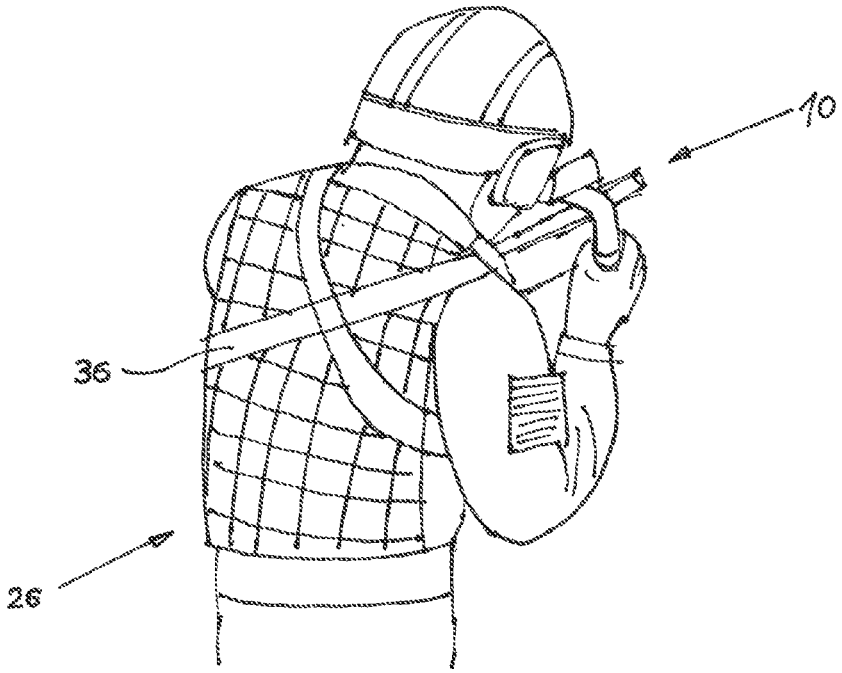
FIG. 10 schematically shows in rear view a user with a firearm according to the invention in shooting position, wherein the firearm is associated with a carrying system.

Thus, the stock 18 of the firearm 10 is disposed on the side of the support structure 28 pointing toward the body of the user 26 when the firearm 10 is in shooting position. The stock 18 itself is provided on the side pointing toward the body of the user 26 with a surface, which—as illustrated in FIG. 9—is in contact with a chest region B situated between the shoulders A of the user 26 when the firearm 10 is in shooting position.

The magazine 20 is constructed as a high-capacity magazine, especially as a pan-type magazine, and according to the invention is disposed below the support structure 28.

FIG. 3 shows a schematic view from the left side of a firearm 10 according to the invention, which as component parts has a barrel 12, not illustrated here, a locking mechanism 14, not illustrated here, a grip 16, a stock 18 and a magazine 20. What is clearly recognizable is the magazine 20 disposed below the support structure 28 as a high-capacity magazine, especially as a pan-type magazine.

Figure 6:
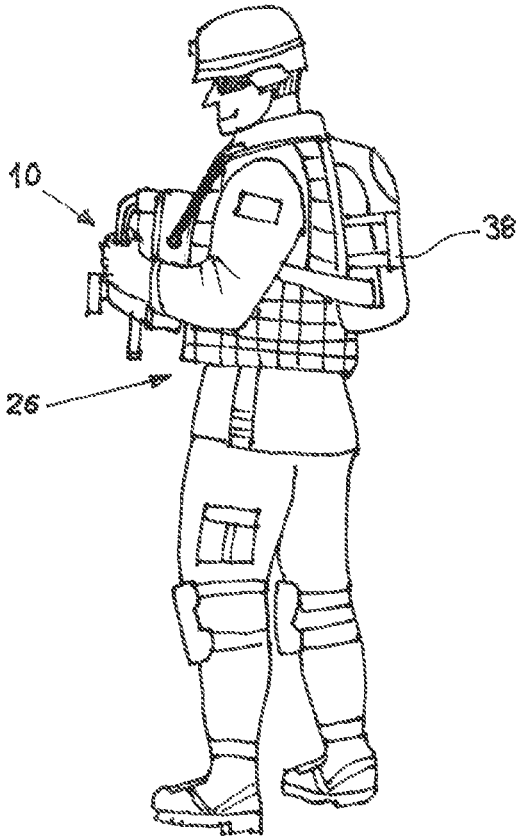
FIG. 6 schematically shows a user with a firearm according to the invention in transport position.
Figure 7:
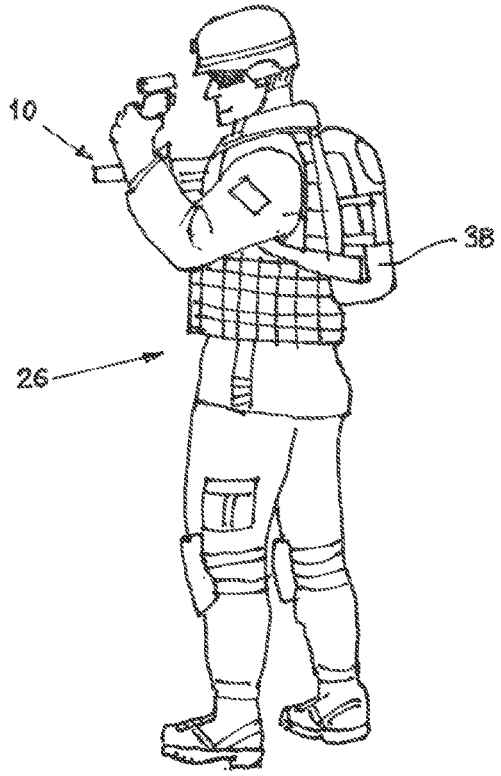
FIG. 7 schematically shows a user with a firearm according to the invention in shooting position.

According to the invention, the firearm 10 has a carrying system 36, via which the firearm 10 is in each case held in front of the body of the user 26 both in a shooting position illustrated in FIG. 6, in which the open end of the barrel 12 of the firearm 10 points forward toward the target and in a transport position illustrated in FIG. 7, in which the open end of the barrel 12 of the firearm 10 points downward. In this way, the firearm 10, by means of the carrying system 36, is suspended with swiveling capability upon the user 26 in front of the body of the user 26, wherein the center of gravity of the suspended firearm 10 is preferably chosen such that a smooth swiveling of the firearm 10 by 90 degrees from a transport position into a shooting position is possible, as can be clearly recognized in a comparison of FIGS. 6 and 7.

Figure 8:
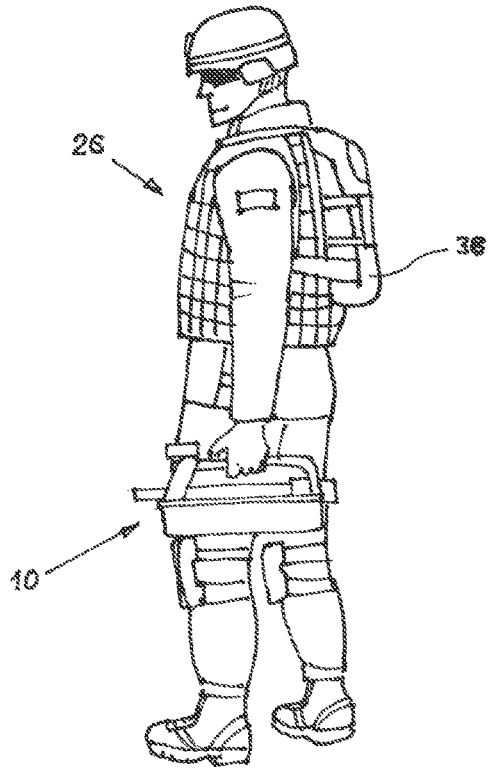
FIG. 8 schematically shows a user with a firearm according to the invention in a further transport position.

The carrying system 36 has a belt joined to the support structure 28 as shown in FIG. 3, in order to fasten the firearm 10 upon the user 26, especially upon backpack straps, if the user 26—as illustrated in FIGS. 6 to 8, is carrying a backpack 38. In the alternative carrying system illustrated in FIG. 10, two straps pass crosswise over the back of the user 26 and are joined to the belt on the front side of the user.

Figure 4:
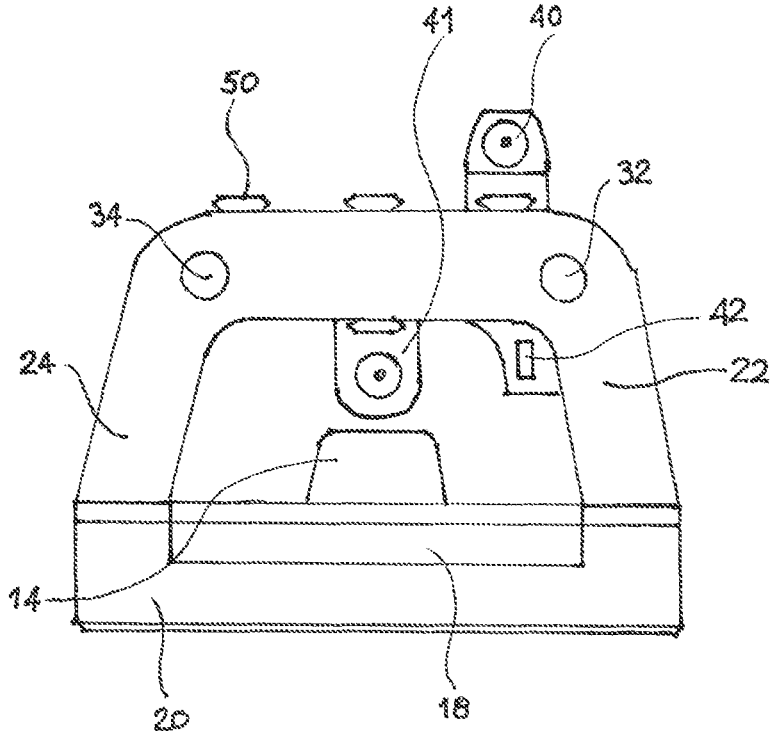
FIG. 4 shows a schematic rear view of a firearm according to the invention.

FIG. 4 shows a schematic rear view a firearm 10 according to the invention. The rear view provides a glance at that side of the firearm 10 pointing away from the body of the user 26 when the firearm 10 is in shooting position. The grip 16 corresponds substantially to the grip 16 illustrated in FIG. 1, but the safety 42 for blocking the triggers 32, 34 is situated in front view on the left instead of the right side.

Figure 5:
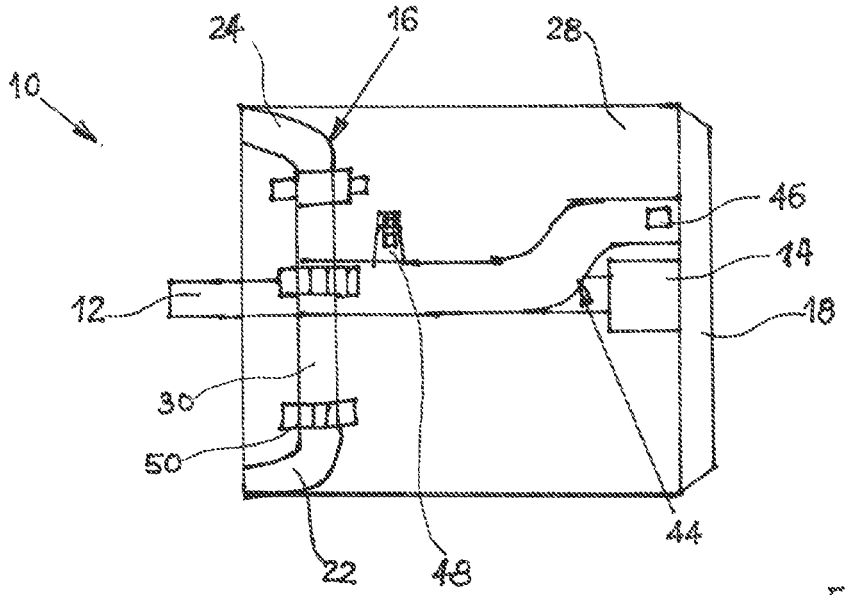
FIG. 5 shows a schematic overhead view of a firearm according to the invention.

FIG. 5 shows a schematic overhead view of a firearm 10 according to the invention, which as component parts has a barrel 12, a locking mechanism 14, a grip 16, a stock 18 and a magazine 20. The grip 16 has a left and a right grip element 22, 24, wherein the user 26 of the firearm 10 grasps the left grip element 22 with the left hand and the right grip element 24 with the right hand, in order to bring the firearm 10 into a shooting position, preferably centrally in front of the body of the user 26, in which position the open end of the barrel 12 of the firearm 10 points away from the body of the user 26 in target direction.

The grip 16 is constructed to be U-shaped, wherein the left grip element 22 is formed by the one leg of the U and the right grip element 24 by the other leg of the U. The free ends of the legs forming the grip elements 22, 24 are joined in this case to a plate-like support structure 28, wherein the part 30 of the U-shaped grip 16 joining the two legs is disposed spaced apart from the support structure 28 and is transverse relative to the barrel 12. Further component parts 12, 14, 18, 20 of the firearm 10 are disposed upon the support structure 28.

Thus, the stock 18 of the firearm 10 is disposed on the side of the support structure 28 pointing toward to the body of the user 26 when the firearm 10 is in shooting position. The stock 18 itself is provided on the side pointing toward the body of the user 26 with a surface, which—as illustrated in FIG. 9—is in contact with a chest region B situated between the shoulders A of the user 26 when the firearm 10 is in shooting position.

The magazine 20 is constructed as a high-capacity magazine, especially as a pan-type magazine, and according to the invention is disposed below the support structure 28.

The firearm 10 has a transport grip 44 (see FIG. 5) in addition to the grip 16, which is designed for holding the firearm 10 in shooting position, wherein the transport grip 44 is disposed in the direction of the barrel 12, and thus in longitudinal direction of the firearm 10, on the support structure 28. This transport grip 44 permits the user 26 to transport the firearm 10 in another way, especially when it is not necessary to bring the firearm 10 quickly into a shooting position. As illustrated in FIG. 8, in this way the firearm 10 can be conveniently held and transported laterally upon the body of the user 26.

Advantageously, a mechanical aiming device in the form of notch 46 and bead 48 may be disposed on the transport grip 44.

Figure 11:
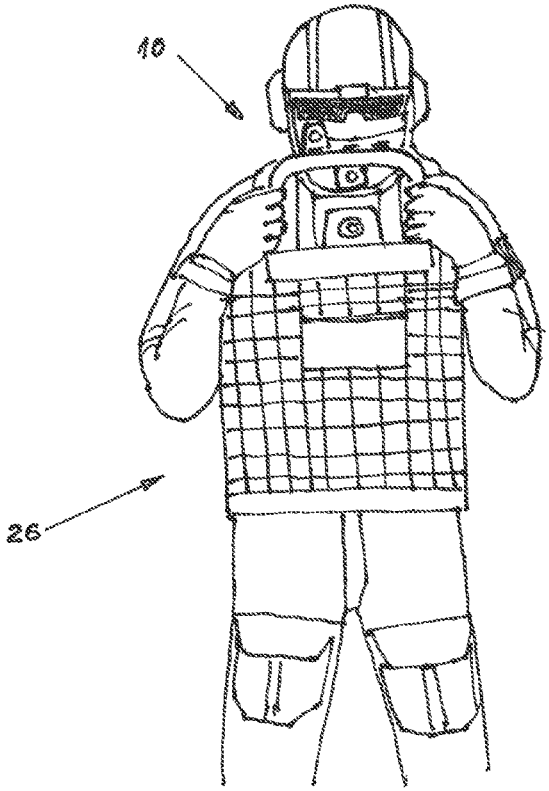
FIG. 11 schematically shows in a full front view a user with a firearm according to the invention in shooting position.
Figure 12:
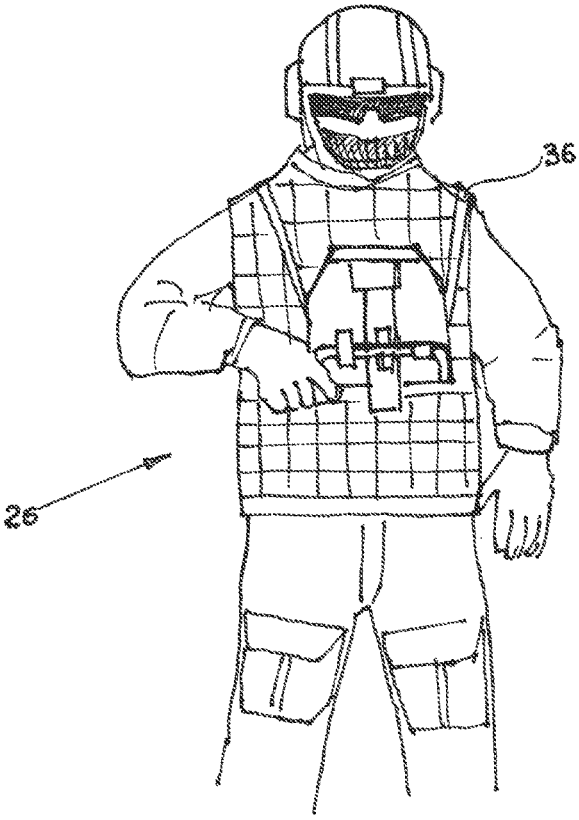
FIG. 12 schematically shows in a full front view a user with a firearm according to the invention in transport position.

Finally, FIG. 11 schematically shows in a full front view a user with a firearm according to the invention in shooting position and FIG. 12 schematically shows in a full front view a user with a firearm according to the invention in transport position.

Although only a few embodiments of the present invention have been shown and described, it is to be understood that many changes and modifications may be made thereunto without departing from the spirit and scope of the invention.

What is claimed is:

1. A portable firearm, comprising component parts comprising:

(a) a barrel having an open end;

(b) a locking mechanism;

(c) a grip comprising a left grip element and a right grip element;

(d) a stock; and (e) a magazine;

wherein the firearm is configured so that a user of the firearm having a body, a left hand, and a right hand grasps the left grip element with the left hand and the right grip element with the right hand in order to bring the firearm into a shooting position wherein the open end of the barrel of the firearm points away from the body of the user, and to hold the firearm during shooting;

wherein the grip is disposed in front of a center of gravity of the firearm relative to a shooting direction of the firearm;

wherein the grip elements are disposed upon a support structure adapted to receive further component parts of the firearm disposed upon the support structure;

wherein the stock is provided on a side of the support structure pointing toward the body of the user with a surface in contact with a chest region situated between shoulders of the user when the firearm is in the shooting position; and wherein the firearm further comprises at least one trigger configured to be actuated by at least one finger of one hand of the user, when the firearm is in the shooting position.

2. The portable firearm according to claim 1, wherein the grip in the shooting position of the firearm is disposed at least predominantly above the barrel.

3. The portable firearm according to claim 1, wherein the grip is U-shaped having first and second legs; and wherein the left grip element is formed by the first leg of the U-shaped element and the right grip element is formed by the second leg of the U-shaped element.

4. The portable firearm according to claim 3, wherein the first and second legs forming the grip elements have first and second ends, respectively, joined to the support structure;

wherein the grip comprises a part joining the first and second legs; and wherein the part of the grip joining the first and second legs is spaced apart from the support structure and is transverse relative to the barrel.

5. The portable firearm according to claim 1, further comprising first and second triggers;

wherein the first and second triggers are configured so that the first trigger can be actuated by at least one finger of the left hand of the user and the second trigger can be actuated by at least one finger of the right hand of the user when the firearm is in the shooting position.

6. The portable firearm according to claim 5, wherein the firearm is constructed in such a way that one shot or more than one shot can be fired only when both triggers are actuated simultaneously in order to reduce hand injuries on a muzzle of the firearm and thereby to increase safety.

7. The portable firearm according to claim 1, further comprising a carrying system configured for holding the firearm in front of the body of the user both in the shooting position, wherein the open end of the barrel of the firearm points forward, and in a transport position, wherein the open end of the barrel of the firearm points downward.

8. The portable firearm according to claim 1, further comprising a carrying system configured to suspend the firearm with swiveling capability upon the user in front of the body of the user;

wherein the firearm is configured to have a center of gravity when so suspended that enables a smooth swiveling of the firearm by 90 degrees from a transport position into the shooting position.

9. The portable firearm according to claim 7, wherein the carrying system has at least one belt configured to fasten the firearm upon the user.

10. The portable firearm according to claim 7, wherein the carrying system has at least one figure eight belt configured to fasten the firearm upon the user.

11. The portable firearm according to claim 1, further comprising at least one aiming device disposed upon the grip, wherein the grip and the at least one aiming device are arranged above the barrel and therefore on the same side as the barrel.

12. The portable firearm according to claim 1, wherein the grip has at least one safety for blocking the trigger.

13. The portable firearm according to claim 4, wherein the grip has at least one trigger in a transition region between one of the first and second legs and the part of the grip joining the first and second legs.

14. The portable firearm according to claim 1, further comprising at least one transport grip in addition to the grip;

wherein the transport grip is disposed toward the barrel in a longitudinal direction of the firearm.

15. The portable firearm according to claim 14, wherein at least one mechanical aiming device is disposed upon the transport grip.

16. The portable firearm according to claim 1, wherein the magazine is a pan-type magazine disposed below the support structure.

17. The portable firearm according to claim 1, wherein the at least one trigger is arranged on the grip.

18. The portable firearm according to claim 5, wherein the first trigger is arranged on the left grip element and the second trigger is arranged on the right grip element.

* * * * *